US009874100B2

(12) United States Patent
Otsubo et al.

(10) Patent No.: US 9,874,100 B2
(45) Date of Patent: Jan. 23, 2018

(54) TURBINE ROTOR AND TURBOCHARGER HAVING THE TURBINE ROTOR

(71) Applicant: MITSUBISHI HEAVY INDUSTRIES, LTD., Tokyo (JP)

(72) Inventors: Hitomi Otsubo, Tokyo (JP); Takashi Arai, Tokyo (JP); Hiroshi Nakagawa, Tokyo (JP); Hideki Yamaguchi, Tokyo (JP); Masakazu Yoshida, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 338 days.

(21) Appl. No.: 14/766,356

(22) PCT Filed: Feb. 22, 2013

(86) PCT No.: PCT/JP2013/054565
§ 371 (c)(1),
(2) Date: Aug. 6, 2015

(87) PCT Pub. No.: WO2014/128930
PCT Pub. Date: Aug. 28, 2014

(65) Prior Publication Data

US 2016/0003059 A1 Jan. 7, 2016

(51) Int. Cl.
*F01D 5/02* (2006.01)
*F01D 5/04* (2006.01)
*F01D 5/28* (2006.01)

(52) U.S. Cl.
CPC ..... *F01D 5/027* (2013.01); *F01D 5/04* (2013.01); *F01D 5/048* (2013.01); *F01D 5/28* (2013.01);
(Continued)

(58) Field of Classification Search
CPC .... F02B 33/00–2039/168; F02B 39/00; F01D 5/027; F01D 5/048; F01D 5/28;
(Continued)

(56) References Cited

U.S. PATENT DOCUMENTS

2005/0036893 A1 2/2005 Decker
2011/0091324 A1* 4/2011 Holzschuh ..... B23P 15/006 416/200 A
(Continued)

FOREIGN PATENT DOCUMENTS

CN 102341567 A 2/2012
EP 2 476 861 A1 7/2012
(Continued)

OTHER PUBLICATIONS

International Preliminary Report on Patentability and Written Opinion of the International Searching Authority (Forms PCT/IB/338, PCT/IB/373, PCT/ISA/237 and PCT/IB/326), dated Sep. 3, 2015, for International Application No. PCT/JP2013/054565, with an English translation.
(Continued)

*Primary Examiner* — Mark Laurenzi
*Assistant Examiner* — Xiaoting Hu
(74) *Attorney, Agent, or Firm* — Birch, Stewart, Kolasch & Birch, LLP

(57) ABSTRACT

A turbine rotor comprising: a turbine wheel 5 obtainable by precision casting of titanium aluminide, including a hub 50 extending along a rotational center of the turbine wheel, and a plurality of impellers 40 arranged along a circumferential direction around an outer circumference of the hub, and having a web-like scallop 30 formed by making a cutout between adjacent impellers among the plurality of the impellers; and a rotor shaft 7 extending along the rotational center line C-C of the turbine wheel on a back side of the hub of
(Continued)

the turbine wheel; wherein the turbine wheel has a balance cut portion 11 arranged along the circumferential direction of the rotational turbine wheel on the back side of the hub of the turbine wheel, wherein an area of the balance correcting part arranged in the circumferential direction is placed so that a balance cut minimum diameter BCmin is larger than a maximum diameter of the rotor shaft on the wheel mounting side, and that a balance cut maximum diameter BCmax is smaller than a scallop diameter S of the turbine wheel, and that a thickness t from the back side of the turbine wheel to a surface of the hub satisfies $1.75t \geq w$, where w is a width in a radial direction of the area arranged in the circumferential direction (i.e. balance cut).

6 Claims, 4 Drawing Sheets

(52) U.S. Cl.
CPC .... *F05D 2220/40* (2013.01); *F05D 2300/174* (2013.01)

(58) Field of Classification Search
CPC ..... F01D 5/04; F01D 5/043; F05D 2220/40; F05D 2300/174
See application file for complete search history.

(56) References Cited

U.S. PATENT DOCUMENTS

| | | | | |
|---|---|---|---|---|
| 2012/0183406 | A1* | 7/2012 | Yoshida | F01D 5/048 416/219 R |
| 2015/0226233 | A1* | 8/2015 | Yagi | F04D 25/163 416/144 |

FOREIGN PATENT DOCUMENTS

| | | | |
|---|---|---|---|
| JP | 61-104349 | U | 7/1986 |
| JP | 63-83430 | U | 6/1988 |
| JP | 63-198702 | A | 8/1988 |
| JP | 7-286528 | A | 10/1995 |
| JP | 10-131704 | A | 5/1998 |
| JP | 10-193087 | A | 7/1998 |
| JP | 2002-47944 | A | 2/2002 |
| JP | 2003-201802 | A | 7/2003 |
| JP | 2003-269105 | A | 9/2003 |
| JP | 2003-302304 | A | 10/2003 |
| JP | 2005-60829 | A | 3/2005 |
| JP | 2007-169731 | A | 7/2007 |
| JP | 2008-534288 | A | 8/2008 |
| JP | 2010-203803 | A | 9/2010 |
| JP | 2011-80410 | A | 4/2011 |

OTHER PUBLICATIONS

International Search Report and Written Opinion of the International Searching Authority (Forms PCT/ISA/210, PCT/ISA/220 and PCT/ISA/237), dated May 21, 2013, for International Application No. PCT/JP2013/054565.

Chinese Office Action effective Dec. 20, 2016 issued in corresponding Chinese Application No. 201380069358.3 with an English Translation.

Extended European Search Report effective Mar. 14, 2016 issued in corresponding EP Application No. 13875417.1.

Decision to Grant a Patent dated Sep. 16, 2016 issued in corresponding Japanese Application No. 2015-501195 with an English Translation.

"High Performance Alloys Developed for Turbocharges", by Kazuaki Nisio et al., Toyota Central R&D Labs., R&D Review, vol. 35, No. 3 (Sep. 2000) (English Abstract).

* cited by examiner

TURBINE ROTOR AND TURBOCHARGER HAVING THE TURBINE ROTOR

TECHNICAL FIELD

The present invention relates to a turbine rotor having, on a back side of a turbine wheel, a balance correcting part provided along the circumferential direction of the turbine wheel, and a turbocharger having such a turbine rotor, particularly to a turbine rotor having a balance correcting part provided on the back side of the turbine wheel obtainable by precision casting of titanium aluminide.

BACKGROUND

A construction of a turbine rotor, which is a base for the present invention, will now be described with reference to FIG. 1.

FIG. 1 is a partial front elevation of a radial turbine rotor comprising a turbine rotor shaft 7 and a turbine wheel 5. The turbine wheel 5 has a hub 50 having a truncated cone-like shape along the wheel rotational center line C-C, and a plurality of impellers 40 in the circumferential direction at approximately regular intervals around the hub 50. Between adjacent impellers 40, a web-like scallop 30 is formed by making a cutout. The scallop 30 is formed between a negative pressure side of an impeller 40 and a pressure side of an impeller 40 adjacent to aforementioned impeller 40. The minimum radius portion between the wheel rotational center line C-C and the inner edge of the scallop 30 is in an approximately intermediate position between the two impellers 40, 40. Accordingly, the scallop 30 has a symmetric shape with respect to the minimum radius portion. The scallop 30 has a role of reducing centrifugal stress and moment of inertia in the turbine wheel 5.

The rotor shaft 7 extends along the wheel rotational center line C-C on the back side of the turbine wheel 5 and is fixed on the turbine wheel 5. The rotor shaft 7 has an intermediate shaft portion 20 having a diameter larger than the rotor shaft mounted integrally thereon on an end side. The rotor wheel is fixed on the rotor shaft 7 via the intermediate shaft portion 20 (see Patent Document 2 and Patent Document 3).

The turbine wheel 5 is manufactured by casting. Accordingly, the casting itself is likely to have a biased weight, i.e. unbalance, with regard to the rotational center. If a turbocharger has a turbine rotor 1 with such a turbine wheel 5 having an unbalance, a centrifugal force is caused due to the unbalance when the turbine rotor rotates at high speed, which may leads to vibration of the turbocharger itself.

In view of this, in order to correct the balance of the turbine wheel manufactured by casting, conventionally an arc-like balance cut portion of which center is on the rotational center line C-C is formed on the back side of the turbine wheel.

In particular, a turbocharger for automobiles among such turbochargers, has been downsized for the purpose of improvement of fuel consumption, and the temperature of the exhaust gas tends to become higher due to increase in performance.

In response to such requirement for increasing performance, a turbine rotor having a turbine wheel composed of TiAl-based alloy which is excellent in heat resistance, which is joined to a shaft composed of steel with a brazing material such as Ni brazing material, is suggested. Such a turbine rotor is disclosed by Non-Patent Document 1, for example.

As the above turbine wheel 5 used for a turbocharger for automobiles is manufactured by casting even though precision casting, it cannot be processed while the rotational balance is kept with regard to the rotational center (c) in the circumferential direction, as in the case of machine processing. Accordingly, conventionally, on the back side of the hub of the turbine wheel 5 obtained by precision casting, a balance cut portion 11 is formed by cutting in an arc-like shape along the circumferential direction of the wheel by means of cutting instrument such as an end mill, or, a boss portion 12 on an end side of the hub 50 is cut, to correct the rotational balance.

The arc-like balance cut portion 11 on the back side of the wheel is preferably formed near the edge of the scallop which is on the outer position than the intermediate shaft portion 20 which is on the rotational center side with a view to correcting the rotational balance. However, since TiAl forming the wheel is a brittle material, if the balance cut 11 is intended to be formed near the edge side of the scallop, the press force in cutting by cutting instrument such as an end mill my propagate to the scallop portion 30 of the impeller, whereby cracks or fracturing is likely to be caused in the scallop portion 30. Further, if the wheel having cracks or fracturing in the scallop portion 30 is rotated at high speed, the cracks or fracturing may be enlarged in the wheel of a brittle material, and the turbine wheel 5 may be damaged during operation.

The reason why cracks is caused in the scallop portion 30 is such that as shown in FIG. 1, since a rotating cutting instrument such as an end mill is pressed on the back side of the turbine wheel 5 to perform cutting processing, a press force acts on the scallop portion 30, whereby cracks is caused in brittle TiAl. On the other hand, Patent Document 1 discloses a technique of correcting the rotational balance by using laser instead of cutting instruments.

However, in such technique, the turbine wheel 5 itself is not processed, but an impeller nut to fasten the impeller 40 is cut for self-aligning. Accordingly, such technique may be applied only to correcting rotational balance of a compressor wheel where the rotor shaft and the impeller are separated.

Further, in such know technique, "in a state where impeller nut is rotated so that the frequency of the vibration of impeller exceeds the primary resonance point where the amplitude becomes maximum, the impeller nut is cut from the front direction by a laser LS of which irradiation position is fixed for self-aligning". Accordingly, such technique has a problem such that balance correction becomes cumbersome, and in particular, the position of the balance correcting part cannot be determined unless the impeller nut is rotated. Thus the technique is not suitable for mass production.

Further, in the technique, the impeller nut is cut by laser from the front side to correct the rotational balance, which is basically different from the present invention where a balance cut portion 11 is formed on the back side of the turbine wheel 5.

CITATION LIST

Patent Literature

Patent Document 1: JP 2010-203803 A (Abstract and FIG. 4)
Patent Document 2: JP Hei10-193087 A
Patent Document 3: JP 2003-269105A (Paragraph 0005)

Non-Patent Literature

Non-Patent Document 1: High Performance Alloys Developed for Turbochargers. Toyota Central R&D Labs. R&D Review Vol 35, No. 3 (2000 September)

SUMMARY

Technical Problem

An object of the present invention is to provide a turbine rotor by which the position of the balance correcting part provided on the back side of the turbine wheel can be clearly defined and by which balance cut or build-up can be equally formed even in mass production, and a turbocharger employing such a turbine rotor.

In particular, an object of the present invention is to provide a turbine rotor by which generation of cracks may be reduced by decreasing, in the case where the balance correcting part is a balance cat, a balance cut maximum diameter BCmax as compared to a scallop diameter S to increase the thickness t at the position of the balance cut maximum diameter.

Another object of the present invention is to provide a turbine rotor wherein the risk of generation of cracks can be reduced as much as possible by increasing a cross-section R of the scallop portion to increase the thickness of the hub at the position of the balance cut.

Solution to Problem

In view of the objects, the present invention provides a turbine rotor comprising:

a turbine wheel 5 obtainable by precision casting of titanium aluminide, including a hub extending along a rotational center of the turbine wheel, and a plurality of impellers 40 arranged along a circumferential direction around an outer circumference of the hub, and having a web-like scallop portion 30 formed by making a cutout between adjacent impellers 40 among the plurality of the impellers 40; and a rotor shaft 7 extending along the rotational center line C-C of the turbine wheel on a back side of the hub of the turbine wheel 5;

wherein the turbine wheel has a rotational balance correcting part including any one or both of a balance cut portion 11 and a balance building-up portion arranged along the circumferential direction of the rotational turbine wheel on the back side of the hub of the turbine wheel 5, wherein an area of the balance correcting part arranged in the circumferential direction is placed so that:

(1) a diameter of the area arranged in the circumferential direction on an inner circumferential side (i.e. a balance cut minimum diameter BCmin) is larger than a maximum diameter of the rotor shaft on the wheel mounting side;

(2) a diameter of the area arranged in the circumferential direction on an outer circumferential side (i.e. a balance cut maximum diameter BCmax) is smaller than a scallop diameter S of the turbine wheel; and (3) a thickness t from the back side of the turbine wheel to a surface of the hub satisfies $1.75t \geq w$, where w is a width in a radial direction of the area arranged in the circumferential direction (i.e. balance cut).

Typically, the rotor shaft 7 has an intermediate shaft portion 20 which is mounted on the rotor shaft integrally and which has a diameter larger than that of the rotor shaft, and in many cases, the turbine wheel 5 is joined with the rotor shaft via such an intermediate shaft portion by brazing or welding using electron beam. The maximum diameter of the rotor shaft on the wheel mounting side means the diameter of the intermediate shaft portion having a diameter larger than the rotor shaft itself, for example.

The scallop diameter as in the above (2) means a diameter from the wheel rotational center to the inner edge of the scallop portion 30.

In order to form the balance cat having a width of an arc-like shape on the back side of the turbine wheel 54 by cutting, it is advantageous that an end mill having cutting blades on the underside and the lateral side.

In the present invention, the minimum diameter BCmin of the arc-like balance cut is larger than the maximum diameter JKmax of the intermediate shaft portion of the rotor shaft (i.e. BCmin>JKmax) as described in the above (1); however, a gap for removing powder arising from the cutting blade on the lateral side of the end mill, or a margin a of $BCmin=JPmax+\alpha x$ may be provided because the end mill has a cutting blade on the lateral side. Typically, the gap may have a width of 2 mm or greater.

Next, the balance cut maximum diameter BCmax will be discussed.

BC max is positioned on the hub side and is smaller than a scallop diameter S of the turbine wheel 5 as described in above (2). And further, the width w in the radial direction of the balance cut is set to be such that the width w satisfies $1.75t \geq w$, where t represents the thickness from the back side of the wheel to the surface of the hub, whereby it is possible to reduce cracks of the turbine wheel 5 at the time of forming the balance cut by cutting, as the present inventors have found from experimental results.

The reason for "$1.75t \geq w$" is such that in a case where the width w in the radial direction of the area arranged in the circumferential direction (balance cut) is set to be 5 mm, if the thickness t is 1 (mm), cracks were caused in all of the samples, and also in a case where the width w in the radial direction is set to be 3.5 mm, if the thickness t is 1 (mm), cracks were caused in all the samples; however, it was found that when the width w in the radial direction is set to be 3.5 and the thickness t is set to be 2 (mm) or greater, generation of cracks can be reduced, as described in the following Examples (see the following conventional example 1 and Example 1).

That is, by the conditions (1) and (2), although the position of the balance correcting part provided on the back side of the turbine wheel 5 is clearly defined, and the effect that balance cut or build-up can be equally formed even in mass production can be obtained, the risk of generation of cracks may not be reduced.

When the balance cut portion 11 is formed by cutting, since the end mill as a cutting tool has an underside of a blade portion, a press force of the end mill is received by the thickness from the back side of the wheel to the hub surface. Accordingly, as the thickness from the back side of the wheel to the hub surface becomes smaller, cracks of the turbine wheel 5 due the press force is likely to be caused.

On the other hand, it is possible to reduce the balance cut maximum diameter; however, with such a configuration, it may be impossible to take advantage of inertial force by the rotation of the wheel.

In view of this, by additionally employing the above condition (3), the effect of the invention may be accomplished.

The above conditions (1), (2) and (3) may be effectively applied to formation of the balance cut portion 11 by cutting on the back side of the turbine wheel 5. In such a case, the area the balance correcting part (balance cut portion 11) may be formed by an area arranged in the circumferential direction of an arc-like shape having the same center as the rotational center.

In a case where the balance correcting part on the back side of the turbine wheel 5 is the balance cut portion 11, the balance cut portion 11 is preferably set to be such that a cut depth Dp at a position of the balance cut maximum diameter BCmax satisfies the following relational expression:

$$Dp<[(\text{thickness } t \text{ from the back side of the turbine wheel to the surface of the hub at the position of } BC\text{max})-Dp] \quad \text{(Condition 4).}$$

That is, by only employing the conditions (1), (2) and (3), although it is possible to reduce the width of the balance cut, it may be impossible to correct unbalance due to the reduction in the volume of the balance cut.

In view of this, by additionally employing the condition (4), it is possible to form a balance cut within a range where cracks are not caused at the time of forming the balance cut, and it is possible to reduce the width of the balance cut without reducing the volume of the balance cut to correct the rotational balance.

By employing the above condition (4), it is possible to correct rotational balance more accurately by increasing the thickness t from the back side of the wheel to the hub surface at the position of the BCmax.

In the present invention, it is preferred that in order to increase the thickness of the scallop portion 30 on the outer edge side of the hub along the thickness direction of the hub, the area is on a position where the balance cut maximum diameter BCmax is such that the thickness t from the back side of the wheel to the hub surface satisfies ≥0.57 w, where w is the width in the radial direction of the area arranged in the circumferential direction.

In the present invention, it is further preferred that:

a hub surface defining an edge line of the impellers on a hub side is formed in an arc-like shape; and the scallop has an R portion formed in an arc-like shape from the back side of the turbine wheel toward the hub surface, wherein the thickness of the scallop portion 30 at the connection point between the R portion and the hub surface is at least 1.8 times larger than the cut depth Dp.

In this configuration, since R of the scallop portion 30 is large, the thickness of the hub at the position of the balance cut, whereby it is possible to reduce the risk of generation of cracks.

The present invention may be usefully applied to a turbine rotor having the balance cut portion 11 formed by machine processing such as end mill processing. That is, end mill processing is effective for high accuracy and mass production as compared with laser processing or ultrasonic wave processing.

The turbine rotor according to the present invention has the balance cut and a build-up of TiAl formed at a blade root part on the back side of the turbine wheel.

According to the present invention, by forming the build-up of TiAl at a blade root part on the back side of the turbine wheel, it is possible to reduce the volume of the balance cut portion 11 and to finely adjust the balancing weight.

Advantageous Effects

According to the present invention, in a turbine rotor having a balance cut portion 11 on the back side of the hub of the turbine wheel 5, the balance cut portion 11 or the build-up formed on the back side of the hub can be clearly defined, and balance cut or build-up can be equally formed even in mass production.

In particular, an object of the present invention is to provide a turbine rotor by which generation of cracks may be reduced by decreasing, in the case where the balance correcting part is a balance cat, a balance cut maximum diameter BCmax as compared to a scallop diameter S to increase the thickness t at the position of the balance cut maximum diameter.

Another object of the present invention is to provide a turbine rotor wherein the risk of generation of cracks can be reduced as much as possible by increasing a cross-section R of the scallop portion 30 to increase the thickness of the hub at the position of the balance cut.

BRIEF DESCRIPTION OF DRAWINGS

FIG. 1A is a front view of a major part of the turbine rotor without showing a bottom part of the rotor shaft, and FIG. 1B is a cross-sectional view along the line A-A in FIG. 1A.

DETAILED DESCRIPTION

Embodiment

Figure 2:
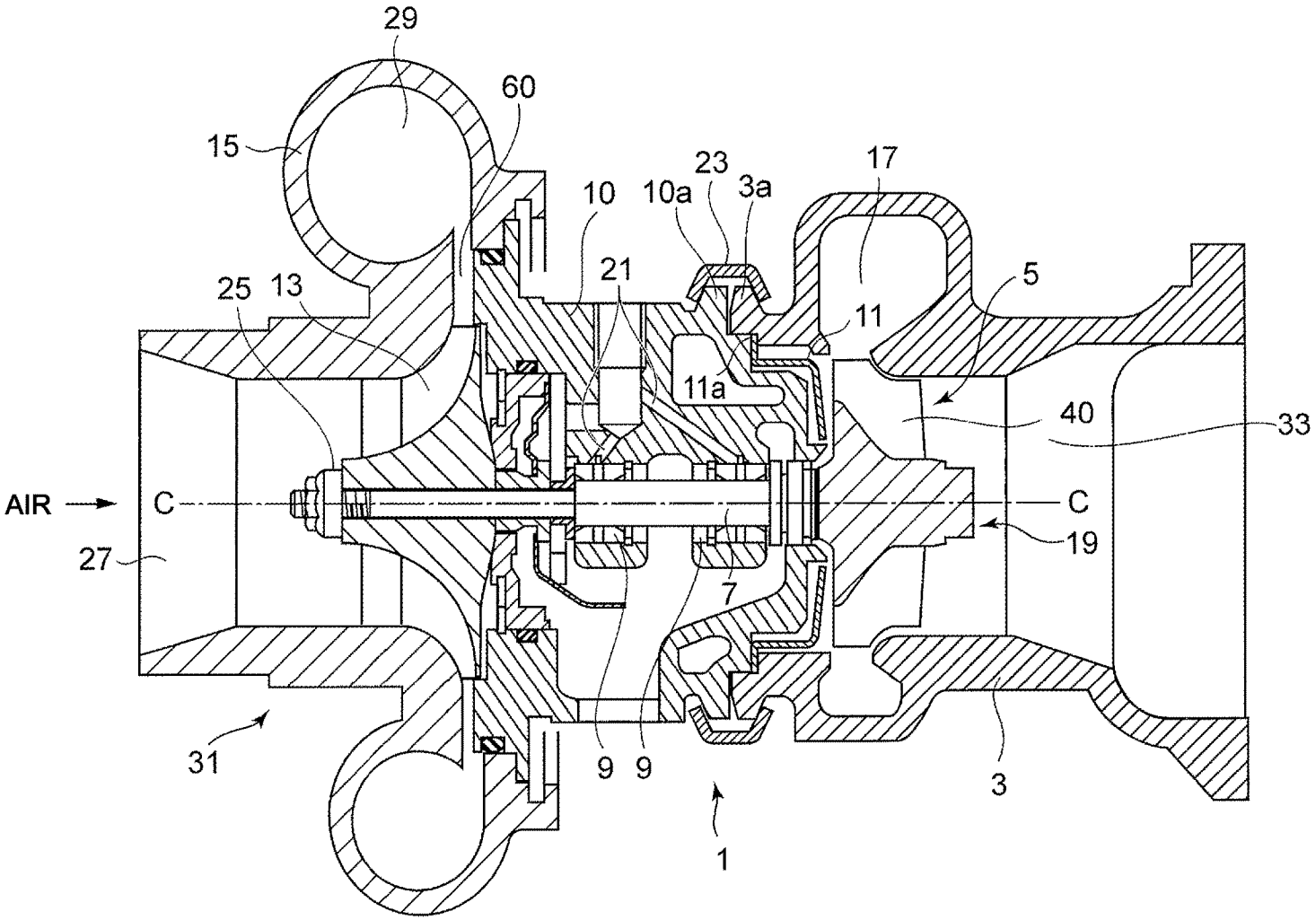
FIG. 2 is a diagram of a turbocharger according to the present invention.

FIG. 2 is a cross-sectional view of a turbocharger 1 having a built-in turbine rotor according to the present invention, along the rotational center line C-C.

Now, overview of the configuration of the turbocharger 1 will be described with an example of a turbocharger for an engine for automobile. The turbocharger 1 has turbine housing 3 having a spiral scroll 17 formed around the outer circumference of the turbine housing 3, and a turbine wheel 5 provided in the central portion of the spiral. The turbine wheel 5 and an end portion of a turbine rotor shaft 7 is joined with each other by a brazing material to constitute a turbine rotor 19. The turbine rotor 19 has a bearing housing 10 having a bearing 9 to rotatably support the turbine rotor shaft 7, and a compressor housing 15 for accommodating an impeller 13 of the compressor, which are disposed adjoiningly along the direction of the rotational center line C-C.

In the bearing housing 10, a pair of bearings 9,9 to rotatably support the turbine rotor shaft 7 around the rotational center line C-C is provided. The bearings 9,9 are configured so that lubricating oil is provided thereto via a lubricant passage 21. The bearing housing 10 and the turbine housing 3 are coupled to each other by fitting an annual snap ring 23 having a substantially U-shape to the outer circumference of facing-each-other protruding flanges 10*a*, 3*a* formed at edge portions of the bearing housing 10 and the turbine housing 3, respectively. In this connecting portion, an outer flange portion 11*a*, which is a fixing portion of a back plate 11 described below, is hold.

On the other end portion of the turbine rotor shaft 7, an impeller 13 of the compressor is fixed with a mounting nut 25. Further, in the compressor housing 15, an air inlet passage 27, diffuser 60 and a spiral air passage 29 are formed to constitute a centrifugal compressor 31.

During operation of the turbocharger 1 having the above configuration, exhaust gas from an engine (not shown) enters into the scroll 17, and is flown from the scroll 17 into the turbine blades of the turbine wheel 5 from the outer circumferential side thereof. Then the exhaust gas is flown along the radial direction toward the central side to do expansion work on the turbine wheel 5, and is flown along the axial direction and guided to the gas outlet 33, and is discharged to outside of the turbocharger.

On the other hand, the impeller 13 is rotated by the rotation of the turbine wheel 5 via the turbine rotor shaft 7 to pressurize the intake air from the air inlet passage 27 of the compressor housing 15 with the impeller 13. The pressurized air is provided to the engine (not shown) through the diffuser 60 and the air passage 29.

Figure 1A:
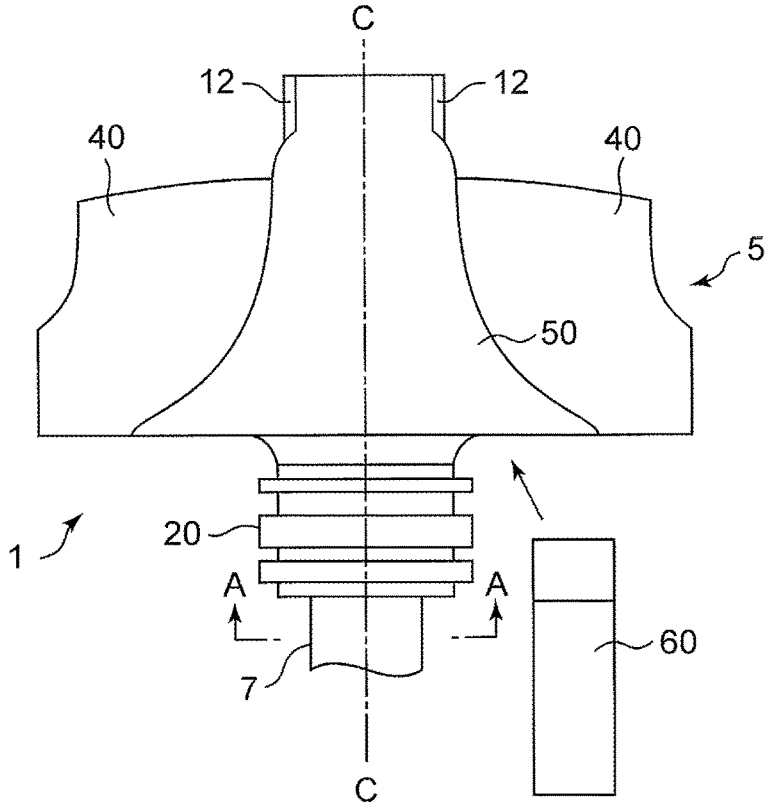
FIG. 1A and FIG. 1B is a diagram illustrating a turbine rotor of the turbocharger shown in FIG. 2.
Figure 1B:
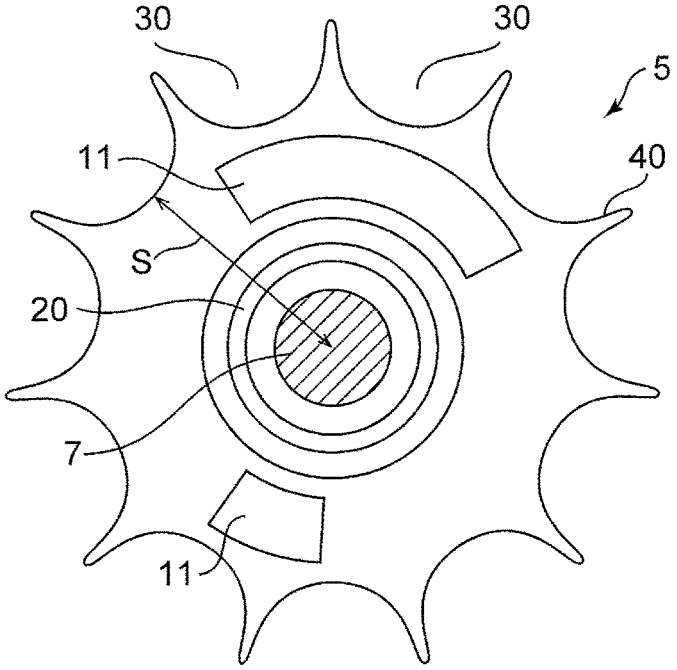

FIG. 1A and FIG. 1B is a diagram illustrating a turbine rotor built into the turbocharger shown in FIG. 2. FIG. 1A is a front view of a major part of the turbine rotor without showing a bottom part of the rotor shaft, and FIG. 1B is a cross-sectional view along the line A-A in FIG. 1A, showing the back side of the turbine wheel.

The turbine rotor shown in the figure comprises: a turbine wheel 5 including a hub 50 extending along a rotational center of the turbine wheel 5, and a plurality of impellers 40 arranged along a circumferential direction around an outer circumference of the hub, and having a web-like scallop portion 30 formed by making a cutout between adjacent impellers 40 among the plurality of the impellers 40; and a rotor shaft 7 extending along the rotational center line of the turbine wheel 5 on a back side of the hub 50 of the turbine wheel 5; wherein the turbine wheel 5 has a rotational balance correcting part including any one or both of a balance cut portion 11 and a balance building-up portion arranged along the circumferential direction of the rotational turbine wheel on the back side of the hub 50 of the turbine wheel 5. (In this figure, a balance cut portion 12 is provided also on the tip side of the hub.)

The turbine wheel 5 is made from a TiAl alloy which is excellent in heat resistance, and the turbine rotor shaft is made from e.g. a steel material such as a SC material or a SCM material. The turbine wheel 5 and the turbine rotor shaft 7 are joined to each other with a brazing material such as Ni-based brazing metal by using high-frequency heating. The rotor shaft 7 has an intermediate shaft portion 20 having a diameter larger than the rotor shaft 7 mounted integrally thereon, and the rotor wheel 5 is connected to the rotor shaft 7 via the intermediate shaft portion 20 by welding.

The balance cut portion 11 is formed by cutting with an end mill 60 as a cutting tool on the back side of the turbine wheel. A pair of balance cut portions 11 having a ring-arc-like form having the same center as the rotational center of the turbine wheel, are formed on the back side of the turbine wheel, which are symmetric with respect to the rotational center of the turbine wheel and each of which is at the position outer than the outer diameter of the intermediate shaft portion 20 and inner than the scallop diameter which is on an outer side than the hub.

The shape of the balance cut portion 11 is not limited to an arc-like shape, and it may be formed into a circle-like shape. The number, position and shape of the balance cut portion 11 is not limited as long as it is formed for correcting the rotational balance.

The balance cut portion 11 is formed by cutting by pressing an end mill 60 on the back side of the turbine wheel 5. Accordingly, the force may applied to the scallop portion 30, and thus cracks may be caused on the back side of the turbine wheel because the turbine wheel is made from a TiAl material.

Conventional Example 1

Figure 3A:
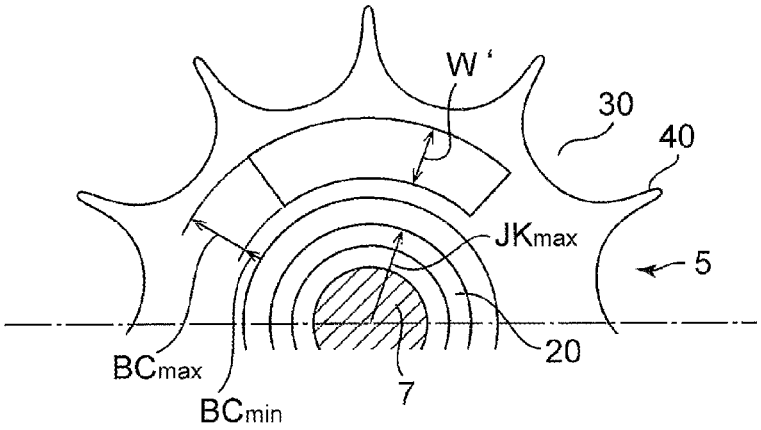
FIG. 3A is a view of a conventional turbine wheel looked at from a back side of the turbine wheel.

In the conventional example as shown in FIG. 3A, for example, in each of the samples of the turbine wheel having an outer diameter of φ52 mm, a maximum diameter (JKmax) of the rotor shaft on the turbine wheel mounting side of φ20 mm, and a scallop diameter of φ34 mm, and a balance cut having a balance cut minimum diameter BDmin of φ22 mm, a balance cut maximum diameter BCmax of φ32 mm (balance cut width W'=5 mm), and a ratio of (maximum diameter at the position of the balance cut)/(scallop diameter) of 94%, was formed. Then, cracks were generated in almost 100% of the samples. (Number of samples: 100)

Example 1

Figure 3B:
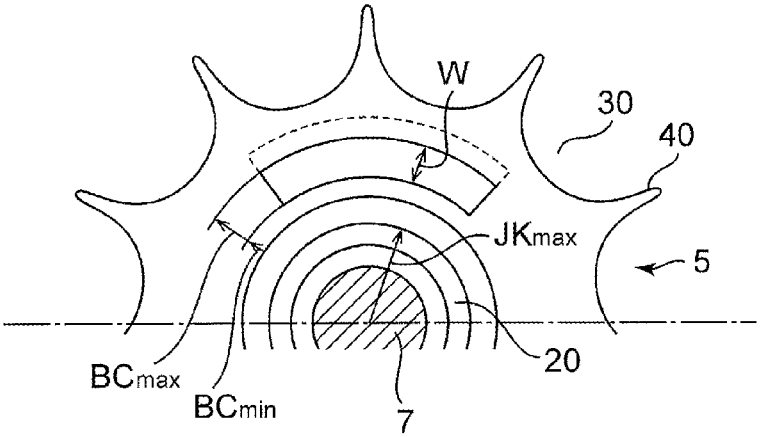
FIG. 3B is a view of a turbine wheel according to an example of the present invention looked at from a back side of the turbine wheel.

As illustrated in FIG. 3B, the balance cut minimum diameter BCmin φ22 mm was the same as the above example, the balance cut maximum diameter BCmax was changed from φ32 mm (balance cut width=5 mm) to φ29 mm (balance cut width w=3.5 mm), and the ratio (maximum diameter at the position of the balance cut)/(scallop diameter) was set to be 85%. Then, the crack generation ratio was reduced from 100% to 30%. (Number of samples: 100)

Figure 3C:
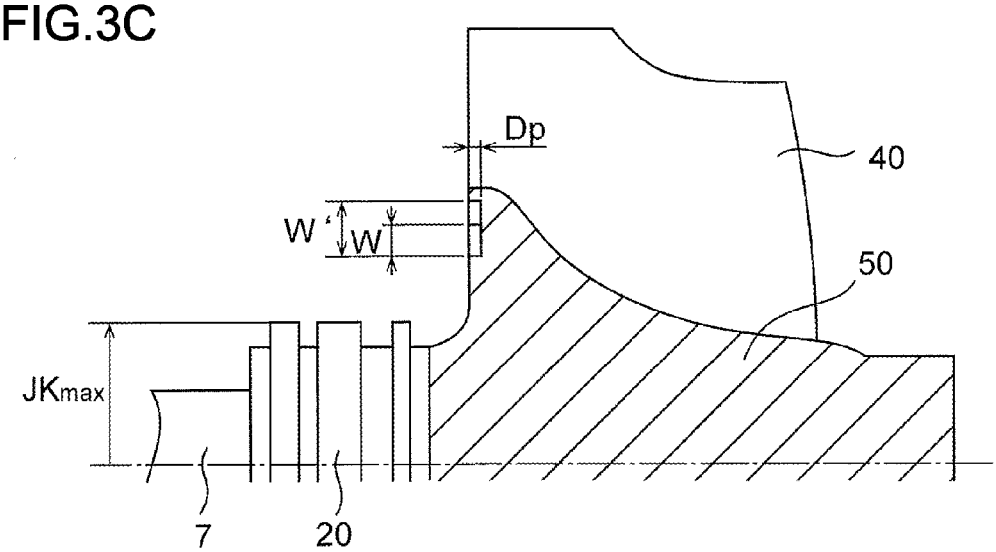
FIG. 3C is a cross-sectional view along an axial direction of the turbine wheel shown in FIG. 3A or FIG. 3B.

FIG. 3C is a cross-sectional view along an axial direction of the turbine wheel shown in FIG. 3A or FIG. 3B.

Next, with regard to each of the turbine rotors having no cracks generated and the turbine rotors having cracks generated, a cut depth Dp at the position of the balance cut maximum diameter BCmax was investigated.

Specifically, 30 samples of turbine rotors having a balance maximum diameter BCmax of φ29 mm (balance cut width=3.5 mm) and having no cracks (the thickness t was 2 mm) and 19 samples of having a cut depth Dp of 5.5 mm or less and having cracks are extracted, and the relation between the thickness t and the cut depth Dp was investigated.

There were 12 samples having a cut depth Dp of 1.5 mm, 18 samples having a cut depth Dp of 2.0 mm, 5 samples having a cut depth Dp of 2.5 mm and 4 samples having a cut depth Dp of 3.0 mm, in increments of 0.5 mm. The samples had a thickness t in a range of from 1.7 mm to 6.2 mm.

It was found that, among the 49 samples, with regard to 30 samples of the turbine wheel 5 which satisfies Dp< [(thickness t from the back side of the turbine wheel to the surface of the hub at the position of BCmax)−Dp], cracks were not generated. In particular, it was found that, among 4 samples having a cut depth Dp of 3.0 mm, with regard to samples having a thickness t of 6 mm (including samples having a thickness t of 5.5 mm or greater because the measurement was in increments of 0.5 mm), cracks were not generate. It can be understood that cracks were not generated if the thickness t is larger than 5.5 mm (1.8 times as large as the cut depth Dp) because the measurement of the thickness t was in increments of 0.5 mm.

From the above results, it was found that by decreasing the balance cut maximum diameter BCmax with regard to the scallop diameter, the thickness at the position of the balance cut maximum diameter BCmax is increase, whereby it is possible to reduce the risk of generation of cracks, and that when the cut depth Dp satisfies the inequality of Dp<[(thickness t from the back side of the turbine wheel to the surface of the hub at the position of BCmax)−Dp], the turbine wheel 5 has no cracks generate.

Accordingly, it can be understood that if the thickness t at the position of BCmax from the back side of the turbine wheel to the hub surface is increased, it is possible to reduce the risk of not being possible to correct unbalance due to a restriction of the cut depth of Dp, and it is possible to correct the rotational balance smoothly.

Example 2

Example 2 of the present invention will be described with reference to FIG. 4A and FIG. 4B, with comparison to the conventional technique.

Figure 4A:
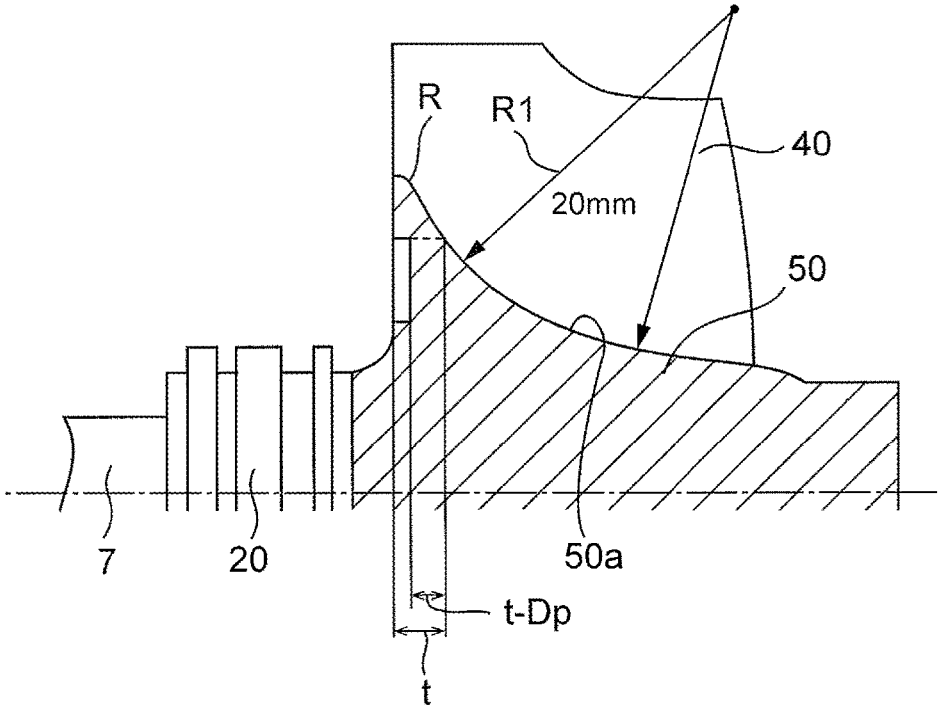
FIG. 4A is a cross-sectional view along an axial direction of Example 2 of the present invention based on the dimensions of Example 1 as shown in FIG. 3B.

FIG. 4A shows a state there the thickness t on the hub side on the flow passage outlet side of the impeller 40 on the back side of the turbine wheel, and the dimensions are the same as in the above Example 1. It is understood from FIG. 4B that in the turbine wheel 5 having such configuration, when the curvature radius R1 of the arc curve defining the hub surface of the impeller 40 is decrease, the R portion of the scallop formed in an arc-like shape toward the hub surface 50*a* from the back side of the turbine wheel 5 is increased in the diameter, and when the diameter of the R portion is increased, the thickness of the scallop portion 30 at the position at the connection point between the R portion and the hub surface 50*a* is increased.

The present invention will be specifically described with comparison to the conventional technique. FIG. 4A is a cross-sectional view along an axial direction of Example 2 of the present invention based on the dimensions of the above Example 1.

As understood from FIG. 4A, when the curvature radius R1 of the arc curve defining the hub surface of the impeller 40 is set to be 20 mm, the R portion of the scallop formed in an arc-like form from the back side of the turbine wheel 5 toward the hub surface 50*a* is decreased, the thickness of the scallop portion 30 at the connection point between the R portion and the hub surface 50*a* is 1 mm, and the ratio (R of the scallop portion 30)/(outer circumference diameter of the rotor wheel) is 2%. With such a shape, cracks were generated at a percentage of almost 100% (number of sample: 100), as described above.

Figure 4B:
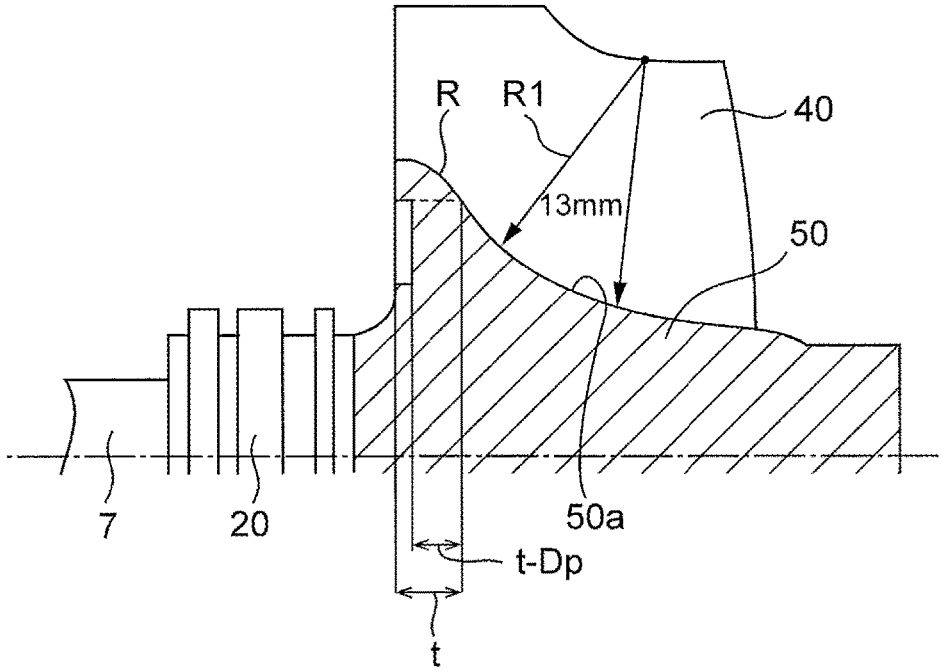
FIG. 4B is a cross-sectional view along an axial direction of a conventional technique.

In view of this, the present inventors have found that by decreasing the curvature radius R1 defining the hub surface 50*a* of the hub 50 as much as possible as shown in FIG. 4B, it is possible to increase the R portion of the scallop portion 30. (In the Example shown in FIG. 4B, the radius is 13 mm.)

That is, it is preferred that the hub surface 50*a* having an arc-like curve R1 defining the edge line at the hub side of the impeller 40, and the R portion of the scallop formed in an arc-like shape from the back side of the turbine wheel 5 toward the hub outer circumferential line R1 are provided, and the thickness of the scallop portion 30 at the portion of the connection point between the R portion and the hub surface is at least 1.8 times, preferably at least 2 times as large as the cut depth Dp.

It has been found that by such a configuration, even when the cut depth Dp is 3.0 mm (number of samples: 4), when the thickness t is from 5.5 to 6 mm, as shown in the above Example 1, cracks were not generated.

If the R of the scallop portion 30 is decreased, the thickness becomes reduced, cracks is likely to be generated at the time of forming of balance cut; however, when the R is increased, the thickness becomes large, whereby it is possible to reduce the risk of generation of cracks, according to the present invention. By increasing the R, the diameter of a circle between the impellers on the back side of the turbine wheel becomes small, whereby it is possible to form the balance cut so that the R portion of the scallop portion 30 becomes maximum to keep the width of the balance cut. The ratio of the thickness of the R portion to the outer diameter of the back side of the turbine wheel may be set to be at least 4%, preferably at least 7%, further preferably 10 to 13%.

INDUSTRIAL APPLICABILITY

As described above, according to the present invention, it is possible to obtain a turbine rotor by which the position of the balance correcting part provided on the back side of the turbine wheel 5 can be clearly defined and by which balance cut or build-up can be equally formed even in mass production.

In particular, the risk of generation of cracks may be reduced by decreasing, in the case where the balance correcting part is a balance cat, a balance cut maximum diameter BCmax as compared to a scallop diameter S to increase the thickness t at the position of the balance cut maximum diameter.

The invention claimed is:

1. A turbine rotor comprising:

a turbine wheel obtained by precision casting of titanium aluminide, including a hub extending along a rotational center of the turbine wheel, and a plurality of impellers arranged along a circumferential direction around an outer circumference of the hub, and having a web-shaped scallop formed by making a cutout between adjacent impellers among the plurality of the impellers; and a rotor shaft extending along the rotational center line of the turbine wheel on a back side of the hub of the turbine wheel;

wherein the turbine wheel has a balance cut portion arranged along the circumferential direction of the turbine wheel on the back side of the hub of the turbine wheel, wherein an area of the balance cut portion arranged in the circumferential direction is placed so that a diameter of the area arranged in the circumferential direction on an inner circumferential side (i.e. a balance cut minimum diameter BCmin) is larger than a maximum diameter of the rotor shaft on the back side, and that a diameter of the area arranged in the circumferential direction on an outer circumferential side (i.e. a balance cut maximum diameter BCmax) is smaller than a scallop diameter S of the turbine wheel, and that a thickness t from the back side of the turbine wheel to a surface of the hub at the position of the balance cut maximum diameter BCmax satisfies 1.75t≥w, where w is a width in a radial direction of the area arranged in the circumferential direction (i.e. balance cut), and wherein the balance cut portion is set to be such that a cut depth Dp at the position of the balance cut maximum diameter BCmax satisfies the following relational expression:

$Dp$<[(thickness $t$ from the back side of the turbine wheel to the surface of the hub at the position of $BC$max)−$Dp$].

2. The turbine rotor according to claim 1, wherein a hub surface defining an edge line of the impellers on a hub side is formed in an arc shape, wherein the plurality of impellers of the turbine wheel are provided to stand along the hub surface, wherein the scallop has an R portion formed in an arc shape from the back side of the turbine wheel toward the hub surface, wherein a position of a connection point between the R portion and the hub surface is on an outer circumferential side of the position of the balance cut maximum diameter BCmax, and wherein the thickness t of the scallop portion at the connection point between the R portion and the hub surface is at least 1.8 times larger than the cut depth Dp.

3. The turbine rotor according to claim 1, wherein the balance cut portion is formed by end mill processing.

4. The turbine rotor according to claim 1, wherein the area arranged in the circumferential direction forming the balance cut portion is an area having an arc shape.

5. The turbine rotor according to claim 1, further comprising a build-up of TiAl formed at a blade root part on the back side of the turbine wheel.

6. A turbocharger comprising the turbine rotor according to claim 1.

* * * * *